US011473241B2

(12) United States Patent
Vehmaa et al.

(10) Patent No.: US 11,473,241 B2
(45) Date of Patent: Oct. 18, 2022

(54) METHOD OF PRODUCING CHEMICAL PULP

(71) Applicant: ANDRITZ OY, Helsinki (FI)

(72) Inventors: Janne Vehmaa, Siltakylä (FI); Kari Kovasin, Rauma (FI); Ismo Reilama, Reila (FI)

(73) Assignee: Andritz Oy, Helsinki (FI)

( * ) Notice: Subject to any disclaimer, the term of this patent is extended or adjusted under 35 U.S.C. 154(b) by 280 days.

(21) Appl. No.: 16/613,825

(22) PCT Filed: May 15, 2018

(86) PCT No.: PCT/FI2018/050362
§ 371 (c)(1),
(2) Date: Nov. 15, 2019

(87) PCT Pub. No.: WO2018/211175
PCT Pub. Date: Nov. 22, 2018

(65) Prior Publication Data

US 2020/0181838 A1 Jun. 11, 2020

(30) Foreign Application Priority Data

May 16, 2017 (FI) ..... 20175442

(51) Int. Cl.
*D21C 3/02* (2006.01)
*D21C 3/22* (2006.01)
(Continued)

(52) U.S. Cl.
CPC ..... *D21C 3/022* (2013.01); *D21C 3/003* (2013.01); *D21C 3/222* (2013.01); *D21C 3/24* (2013.01); *D21H 11/02* (2013.01)

(58) Field of Classification Search
CPC ..... D21C 3/02; D21C 3/003; D21C 3/222
See application file for complete search history.

(56) References Cited

U.S. PATENT DOCUMENTS 5,450,892 A 9/1995 Gautreaux, Jr.
6,143,130 A * 11/2000 Stigsson ..... D21C 1/06 162/29
(Continued)

FOREIGN PATENT DOCUMENTS

EP 0 517 689 12/1992
EP 0 903 436 3/1999
(Continued)

OTHER PUBLICATIONS

International Search Report for PCT/FI2018/050362, dated Aug. 24, 2018, 5 pages.
(Continued)

*Primary Examiner* — Anthony Calandra
(74) *Attorney, Agent, or Firm* — Nixon & Vanderhye P.C.

(57) ABSTRACT

A method of producing chemical pulp including at least the following steps: a) wood chips or other comminuted lignocellulosic fibrous material is treated with a polysulfide-containing cooking liquor in an impregnation stage at a temperature of 90-145° C., and b) slurry of fibrous material from step a) is heated into cooking temperature and cooked for producing pulp having a desired kappa number. After step a) mercaptide ions are added into the slurry of fibrous material and the fibrous material is treated at cooking temperature in step b).

15 Claims, 1 Drawing Sheet

(51) Int. Cl.

| | |
|---|---|
| ***D21C 3/00*** | (2006.01) |
| ***D21C 3/24*** | (2006.01) |
| ***D21H 11/02*** | (2006.01) |

(56) References Cited

U.S. PATENT DOCUMENTS

| | | | | |
|---|---|---|---|---|
| 8,771,464 | B2 * | 7/2014 | Kouisni | D21C 11/0007 162/16 |
| 2010/0236733 | A1 * | 9/2010 | Tikka | D21C 11/06 162/68 |

FOREIGN PATENT DOCUMENTS

| | | |
|---|---|---|
| FI | 118 347 | 10/2007 |
| RU | 2424387 | 7/2011 |
| WO | 95/23256 | 8/1995 |
| WO | 2005/064075 | 7/2005 |
| WO | 2009/067231 | 5/2009 |
| WO | 2013/032377 | 3/2013 |

OTHER PUBLICATIONS

Written Opinion of the ISA for PCT/FI2018/050362, dated Aug. 24, 2018, 6 pages.
Russian Patent Office cited in Application No. 2019141267 completed Sep. 2, 2021, 10 pages.
Search Report cited in Application No. 2019141267 completed Dec. 2, 2021, 4 pages.

* cited by examiner

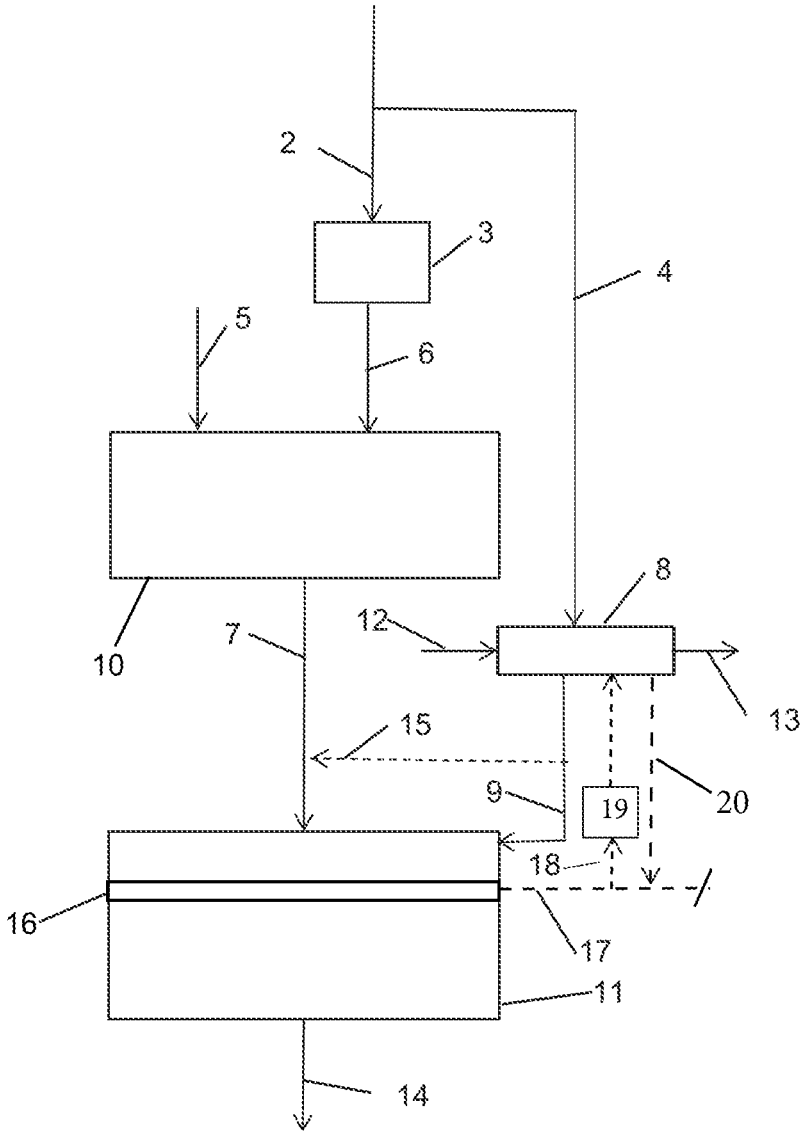
2
3
4
5
6
10
7
12
8
13
15
9
19
20
18
16
17
11
14

METHOD OF PRODUCING CHEMICAL PULP

RELATED APPLICATION

This application is the U.S. national phase of International Application PCT/FI2018/050362 filed May 15, 2018, which designated the U.S. and claims priority to Finnish Patent Application FI 20175442 filed May 16, 2017, the entire contents of each of which are hereby incorporated by reference.

The present invention relates to a method of producing chemical pulp, said method comprising steps that are carried out in a single vessel or in separate vessels. Especially the invention relates to the so-called polysulfide cook.

In chemical pulp production with the sulfate method a sulfide i.e. HS-ion acts as catalyst of the cook, which boosts the cook and improves the yield compared to a cooking solution containing sodium hydroxide (NaOH) only. In sulfate cooking, the ratio of sodium sulfide to sodium hydroxide is described with a parameter sulfidity. In a sulfate pulp mill the highest sulfidity of the cooking solution, due to the balance of the cooking process, washing and recovery process, is approximately 40%, after which the amount of sulfur in the flue gases of the recovery boiler increases above the approved level. Increased $SO_2$ emission is due to the fact that the amount of alkaline metals being released from black liquor during combustion is no more adequate for reacting with all released sulfur. Thus, also the 40% sulfidity is the practical highest level that is aimed at, as a result of which in most cases the best yield of cook is obtained and also the most efficient cooking process so that recovery and cooking are in chemical balance. However, it has been noticed that if it was possible to introduce a greater amount of sulfur into the cook, it would have beneficial impacts both in view of the advancing of the cooking process and the quality of the pulp. Nevertheless, the amount of sulfur cannot be increased due to environmental reasons without arranging new paths for the sulfur circulation. Not all sulfur compounds are advantageous, but the sulfur is to be introduced in such a form that it is active with cooking chemicals. Thus, e.g. dimethyl sulfide or tiosulfate are not advantageous under sulfate cooking conditions.

In view of recovery as such, the sulfidity level is not essential, but the ratio of sulfur and sodium is essential. A 40% sulfidity is a kind of maximum limit, in which almost all sulfur is in the form of sulfide. In chemical recovery, the limit is in reality met also when sulfur is in another chemical form than sulfide, since in the combustion process in a recovery boiler substantially all sulfur compounds are in some stage in the form of one and the same chemical compound. Thus, it is not possible to design a process with a sulfidity of at least 40% and which would additionally use a remarkable amount of some other sulfuric chemical as cooking additive. In a final situation the ratio of sulfur and sodium increases to a level at which sulfur emissions typically exceed the approved emission limits.

Polysulfide (PS) is a cooking additive that is used for increasing the yield of the cook. Polysulfide is typically produced by catalytic oxidation of sulfide ions of white liquor. This oxidation process converts the sulfide into polysulfide, whereby the color of the liquor changes to orange, which is the reason why polysulfide liquor is also referred to as "orange liquor". As a result of oxidation, the sulfidity of the liquor decreases by at least the amount, by which sulfur has been converted into polysulfide. A decrease in the amount of HS-ions simultaneously leads to deceleration of the catalytic impact of sulfidity.

Polysulfide has typically been presented to be used in softwood digestion, whereby pulp is cooked to a kappa number of typically 22-70, most typically 26-45. At lower kappa numbers, i.e. 22-26, delignification is highly unselective, so that the advantage of polysulfide is not evident. On the other hand, if the kappa number is over 40, the alkali charge has to be decreased for the quality of pulp, whereby the concentration of polysulfide decreases respectively, and simultaneously the yield advantage.

Though polysulfide is typically presented to be used in softwood digestion for increasing the yield, it does provide advantage also in hardwood digestion for adjusting and modifying the hemicellulose concentration. Therefore, the strength of polysulfide pulp is advantageous compared to kraft pulp and additionally its beatability can be quicker.

Polysulfide liquor oxidizes the end groups of hemicellulose and decelerates alkaline pealing off reactions, thus leading to an increased hemicellulose yield.

The lignin reactions of a cook can be divided to three various stages: initial delignification, bulk delignification and residual delignification. The initial delignification stage mainly takes place in an impregnation stage, much earlier than the final cooking temperature is achieved. The delignification velocity increases remarkably in the bulk delignification stage, where the temperature is over 140° C. The bulk delignification stage continues until approximately 90% of the lignin has been dissolved. The residual delignification stage is considerably slower than the bulk delignification stage.

In the production of polysulfide cooking liquor, so-called orange liquor, sulfide of white liquor is oxidized into polysulfide. However, part of the sulfide is oxidized into tiosulfate, which has been considered as a passive chemical during cooking. It has also been presented that tiosulfate can even be detrimental in view of the cooking result. Polysulfide efficiently increases the yield of cook only when it is introduced at the beginning of the cook, e.g. in an impregnation stage, where the temperature is typically below 140° C. At a higher temperature polysulfide quickly starts to degrade. The whole polysulfide solution (orange liquor) is most advantageously added at an initial stage of the cooking process in order to ensure the highest possible concentration of polysulfide in the chips, which provides the best impact on the yield of the cook. The sulfur of polysulfide oxidizes end groups of carbohydrates at the beginning of the cook and decelerates peeling off reactions, which is the reason of better selectivity and obtained yield of polysulfide cook compared to sulfate cook. As the cooking advances, polysulfide partly disintegrates back to sulfide, but a remarkable portion of it converts into tiosulfate. The final stage of the cook is very much like a conventional sulfate cook. When comparing to a sulfate cook carried out with white liquor, the sulfide concentration of the polysulfide cooking liquor is remarkably lower due to the above mentioned reasons, which explains slower delignification. This deceleration of the cook is in practice compensated with increase of the cooking temperature, i.e. a polysulfide cook requires a higher H-factor than a sulfate cook for reaching the same kappa number. However, this is not advantageous in view of the yield. Thus, it would be advantageous to have the same sulfidity level of a polysulfide cook as in a kraft cook, but that is not possible because of the balance of the chemical cycle.

In a sulfate cook, and also in a PS-cook part of the sulfur compounds taking part in the delignification is at the end of the cook still in an active state as hydrogen sulfide ions and mercaptide ions. These are released as hydrogen sulfide and methyl mercaptan together with other volatile reaction products, such as methanol, dimethylsulfide and dimethyldisulfide in connection with expansion of the cooking liquor at a digester plant and in connection with the concentration of black liquor at an evaporation plant. They are collected as so-called concentrated odorous gases to be combusted in a lime kiln, a recovery boiler or a separate odorous gas boiler. The methyl mercaptan and hydrogen sulfide contained in concentrated odorous gases are a possible source of additional sulfur required by the cook. Returning them into the cook does not increase the sulfidity of the whole chemical cycle, but only the sulfidity of the cook, since they pass the recovery boiler, wherein the sulfidity causes a problem.

Especially introduction of mercaptide into the cook is supposed to accelerate the delignification. Addition of hydrogen sulfide ions corresponds to the increase of the sulfidity of white liquor.

As to a polysulfide cook, it has been noticed that it is advantageous to cook the pulp in such a cooking process where most or all of the alkali charge is introduced immediately at the beginning of the cook and the concentration of the polysulfide is the highest immediately during impregnation. In view of the cook it is essential to get the polysulfide into the chips as efficiently as possible before the temperature is raised above approximately 140° C., above which polysulfide starts to disintegrate.

In pulp digestion, organic components in wood dissolve as reaction products into the cooking liquor, whereby a great amount of various organic and inorganic compounds are generated. Of these, the best known inorganic compounds are salts containing sodium and sulfur, residual alkali of the cooking solution, HS-ions and carbonate in various forms. The amount of organic compounds is remarkably great, whereby unambiguous specification of them is more difficult. In view of sulfate cook the most difficult group is formed of odorous compounds, such as hydrogen sulfide, dimethylsulfide and ion forms of sulfur and mercaptan. Typically, their boiling point can be remarkably lower than that of water and they evaporate intensively at those temperatures, at which liquor is treated. Additionally, some odorous compounds are explosive above certain concentrations and at very low temperatures.

Vaporization of various compounds of the cook hampers the treatment of cooking liquor, since the treatment is to be carried out so that odorous compounds are prevented from being released into the environment. The odorous compounds are treated either by combustion or absorption into some liquid. On the other hand, by means of vaporization under suitable conditions these compounds can be recovered at a very high concentration, if the aim is to separate these compounds as by-products or utilize them in the process.

It is known that methyl mercaptide originating from odorous compounds acts as catalyst of the cook in the same way as sulfidity. Thus, in the presence of mercaptide the cook can be accelerated aiming at the same kappa number, or correspondingly the temperature of the cook can be lowered, i.e. the cook can be carried out with a smaller H-factor. This has an advantageous impact on the yield and quality of the pulp, especially with respect to polysulfide cook. However, it has been noticed that mercaptide under the conditions of the beginning of the cook catalyzes the degradation of polysulfide so that the polysulfide does not have enough time to be absorbed into the fibrous material, such as wood chips, Thus, mercaptide is a chemical that accelerates the cooking process; however, it cannot be used e.g. in the same way as anthraquinone in connection with polysulfide cook.

FI-patent 118347 discloses a method in which wood chips are digested in a cooking liquor containing organic mercaptide ions. The method is based on avoiding the deceleration of polysulfide cook by adding into the cook methyl mercaptan and thus obtaining the advantage of polysulfide cook, i.e. greater yield compared to a sulfate cook. The mercaptan compound to be added into the polysulfide cooking liquor is obtained by washing with alkali mercaptan-containing odorous gases of a chemical pulp mill and gases generated in thermal treatment of black liquor. However, this patent does not disclose how the introduction of polysulfide and methyl mercaptan is to be carried out in order to achieve the yield benefit.

SUMMARY

An object of the present invention is to provide a method in which the yield of poly-sulfide cook can be improved so that the quality properties of the pulp can be optimized. Especially the new method utilizes the cook-accelerating impact of mercaptide, such as methyl mercaptide, so that impacts of polysulfide and the impact of mercaptide in the cook can be optimized. The present invention describes how under the conditions of polysulfide cook the methyl mercaptan is introduced into the cook so that it is advantageous in view of pulp yield and especially in an industrial cooking process.

The present invention relates to a method of producing chemical pulp, said method comprising following steps that are carried out in a single vessel or in separate vessels:

a) wood chips or other comminuted lognocellulosic fibrous material is treated with polysulfide liquor in an impregnation stage at a temperature of 90-145° C., b) slurry of fibrous material from step a) is heated to cooking temperature and cooked for producing pulp having a desired kappa number and after step a) mercaptide ions are added into the fibrous material slurry and the fibrous material is treated with mercaptide ions-containing cooking liquor at the cooking temperature in step b).

Since the impact of polysulfide is most substantial immediately during impregnation and it typically degrades after impregnation, polysulfide has to be dosed immediately at the beginning of the cook into the impregnation, During the impregnation stage the temperature is low, 90-145° C., typically 100-135° C., so that the reactions of the cooking process are mainly mass transfer reactions and neutralizing reactions and initial delignification, whereby no cook-accelerating chemical is needed. In accordance with the invention, mercaptide is added after impregnation into the cook so that it is present before the temperature of the fibrous slurry is raised to cooking temperature. The cooking temperature is over 140° C., typically 145-175° C. The method according to the invention is based on a surprising observation that the mercaptide is to be introduced in a certain limited stage of the cooking process, when polysulfide has already been impregnated into the fibrous material, such as chips. Thus, increase of sulfidity is carried out at the beginning of the cooking stage, which is advantageous in bulk delignification.

Addition of mercaptide means addition of mercaptide ions or increasing their amount in the cooking liquor. A mercaptide ion can be introduced into the solution in form of a corresponding mercaptan compound or of a corresponding salt of mercaptan compound (mercaptide compound). In an alkaline liquor the mercaptan or mercaptide compound is dissociated and forms mercaptide ions into the solution. Advantageously it is methyl mercaptan and thus methyl mercaptide ion, and those are used in the more detailed description of the invention. Also other suitable organic mercaptan compounds and corresponding mercaptide ions can be used.

Mercaptan is added in the amount of 1-10 kg S (sulfur)/ADT (air dry pulp ton), preferably 2-7 kg S/adt. Advantageously mercaptan is added in the amount that is obtained from suitable odorous compounds of a chemical cycle in connection with the cooking process. If mercaptan is introduced from outside the process, mercaptan can be added in a greater amount, e.g. 10-20 kg S/adt, but no remarkable yield benefit is obtained, especially when compared to its disadvantages in the process.

The concentration of polysulfide compounds in the cooking liquor is approximately 1-12 g/liter, preferably 2-8 g/liter, most preferably 4-7 g/liter (calculated as the amount of sulfur).

The aim is to keep the liquid to wood ratio of the cook as low as possible, whereby polysulfide is impregnated in as high concentration as possible. Thus, the liquid to wood ratio is preferably less than 4.5 and most preferably 3.5 or less, such as 2.5-3.5. In practice the liquid to wood ratio of a cook is not below 2.5, since the factors that have influence on the ratio, i.e. chip moisture, alkali charge and the amount of steam for chip steaming, have a volume of approximately 2.5. In special cases a level of 2 can be reached, but that kind of embodiments are seen in mills at short periods only.

In a cook the alkali charge is typically 12-23% of effective alkali as NaOH calculated on wood. In softwood digestion the alkali charge is between 16-23% of effective alkali as NaOH on wood, and most typically between 18-22%. With a high kappa pulp having a kappa number of 50-120 the alkali charge is smaller, e.g. 12-14% of effective alkali, when the kappa number is over 100.

The alkali charges in hardwood pulping are lower than those of softwood pulping, i.e. usually approximately 14-20% of effective alkali as NaOH on wood. It is rarer that pulp having a kappa number of over 30 is made from hardwood, whereby the alkali charge of the cook can be lower than the mentioned value. However, there is no systematic published information on this kind of applications.

In the new softwood cooking processes the cooking time is typically determined so that with an H-factor of 800-1700 the retention of the cooking process can be adjusted below six hours, whereby washing carried out in a digester is about half an hour and even at the longest below one hour. The retention of impregnation is approximately one hour or one and a half hour in case the cooking process has a separate impregnation vessel. This way, the cooking time is most typically approximately four hours, but by raising the temperature of the cook the cook can be remarkably accelerated. When the production volume of an existing digester is changed, impregnation, cooking time and digester washing can be substantially shortened, and correspondingly the target temperature of the cook is increased and the retention time and the dilution factor of digester washing have to be decreased.

It is known that a cooking process in all stages can be lengthened for several hours and impregnation can be carried out in unpressurized and pressurized vessels. Further, a several hour long "Hi-Heat" process known per se, and bottom washing, can be connected to the cooking process. Nevertheless, in new large production cooking processes e.g. "Hi-Heat"—washing has been abandoned due to low efficiency and costs.

A digester typically has one or more liquor circulations, in which liquor extracted from the digester via a screen is returned into the digester. The liquor being circulated can be augmented with cooking chemicals. According to an embodiment of the invention, mercaptide ions are added into the liquor circulation that is after impregnation of polysulfide, whereby catalytic degradation of polysulfide caused by mercaptide does not take place anymore. According to another embodiment, gas containing methyl mercaptan is added into the vapor phase space of the digester, whereby it is converted to mercaptide ion with alkali of the cook. As is known, slurry of cooking liquor and chips or other comminuted cellulosic fibrous material can be heated to cooking temperature with steam in the vapor phase space of the digester or with hot cooking liquor.

The method according to the invention provides a new cost-efficient method of adding polysulfide and mercaptide into a cooking process. Thus, the polysulfide is added into impregnation at a low temperature when actual cooking reactions are essentially not taking place yet, but still the polysulfide acts as yield-increasing aid. Mercaptide is not added until the temperature of the chips or other material being digested is raised to a level where actual cooking reactions in a bulk delignification stage take place. In that stage, it is essential to accelerate the cooking reactions, because in that way the cook is made to take place with the same H-factor as in a normal kraft-cook. Thus the yield of the cook is better than in a conventional polysulfide cook.

A main principle of the invention is that the orange liquor of polysulfide, which forms at least 65%, typically at least 85% of the alkaline liquor charge required in the cook, is added immediately into the impregnation stage and the mercaptide is added in a stage when the actual cooking is started, i.e. the temperature is raised to a level of 140-170° C., typically 145-175° C., and cooking reactions dominate. The rest of the required alkaline cooking liquor, typically 0.2-35%, typically 0.2-15% is introduced into the fibrous material after impregnation either in form of white liquor or polysulfide liquor. Also sodium hydroxide can be added. If the aim is to introduce only the amount of alkali into which the mercaptide is absorbed, then the alkali addition is approximately 0.2-3% of the total alkali.

In the method wood chips or corresponding fibrous material is cooked to a kappa number of 10-120. Lignin can be selectively separated, whereby pulp having a kappa number in the range of 20-35 can be produced. However, the cook can also be carried out so that the kappa number remains higher, e.g. 40 or even up to a kappa number of 120.

Methyl mercaptan and hydrogen sulfide are both ionizing compounds and they can be selectively recovered by absorbing them into orange liquor of a PS-process or into white liquor of a sulfate cook and returned back into the cook.

Mercaptide acts as accelerator of the cook. This is due both to the chemical nature of mercaptide and the fact that it increases the sulfur-content of the cook. It acts in both kraft and polysulfide cook, but in a polysulfide cook it is essential that mercaptide is not present when polysulfide is added into the raw material of the fibrous material, such as into chips. Polysulfide is not a stabile compound, but it degrades further as a result of several various mechanisms. Thus it is of special importance that during impregnation of polysulfide there are no such compounds that catalyze degradation reactions of polysulfide. This kind of compounds are e.g. some sulfur compounds that are met in circulations of a chemical pulp mill.

If mercaptide is used in kraft pulp production without polysulfide, alkali of the cook can be distributed into different stages of the cook in a way that is sensible for each pulp. If the cooking process is e.g. a Lo-Solids® cook, then for softwood 50-80% of the alkali is introduced into impregnation and the rest into a cooking circulation. In this case the mercaptide can be added either into impregnation or into a Lo-Solids® cooking circulation, which circulation typically has, as known per se, an inlet conduit for dilution liquor.

Methyl mercaptan is a volatile compound that is typically recovered from an evaporation plant from those evaporation units which have the highest temperature, such as from a concentrator or from the first stage, and additionally in the recovery of secondary heat of the cook from odorous gases, which usually are made odorless by combustion. As a further benefit, the thermal load of the recovery boiler decreases, because in combustion mercaptan produces heat and thus causes generation of heat in the combustion process. Addition of mercaptide increases the sulfur content of the cooking process. Therefore, the chemical circulation should preferably be based on removal of sulfur added into the cook, which removal is performed during the cook or at the latest before combustion of sulfur-containing gas.

Since methyl mercaptan is a sulfur compound and its separation takes place mainly in gaseous form, it is to be added either as gas into the vapor phase of the cook or as absorbed into a small amount of alkaline liquor of the cook. These two alternatives form advantageous embodiments that can be carried out in several ways.

In the new method, in the sulfur cycle of the mill mercaptan is preferably separated from the liquor of the cook and taken to the beginning of the cook either in gaseous form or absorbed in an alkali solution. In the absorption the temperature of the alkali has to be low, typically 0-70° C., preferably 0-50° C., most preferably 0-30° C. If the temperature is close to 70° C., the volume of alkali increases correspondingly, if the absorption is not performed in a pressurized vessel.

Absorption of mercaptan-containing gas can be performed in a gas scrubber. If the alkali in the absorption is white liquor or orange liquor, it has to be cooled before taking it into the gas scrubber. The amount of alkali needed in the gas scrubber is at the most approximately 10 kg of alkali for recovering 5 kg of sulfur. This corresponds to approximately 0.2-1% of the total alkali charge calculated on wood. Thus, the amount is not substantially large, though this alkali passes the impregnation of the cook and thus the concentration of polysulfide decreases.

The alkali in the gas scrubber can be a make-up alkali required by the chemical circulation and the cook, nowadays typically sodium hydroxide. Earlier sodium could also be introduced as sodium carbonate, but nowadays this is not done often, because the cost effect of both chemicals is the same. Sodium is introduced into the process so that a cold make-up sodium hydroxide is introduced into the gas scrubber and gaseous mercaptan is absorbed into it. When also in this case the alkali requirement is approximately 10 kg of alkali per 5 kg of sulfur of the mercaptide, this amount is fairly close to the typical requirement of additional chemical in mills.

Mercaptan dissolves in alkali at a low temperature, e.g. below 50° C. Thus the mercaptide can be introduced into the liquor circulations of the cook with the cooking liquor. In case of a polysulfide cook, a small partial stream of polysulfide cooking liquor is cooled and mercaptan is added into it. Then the main portion of the cooking liquor is orange liquor, which is led to the beginning of impregnation. On the other hand, it is not advantageous to use orange liquor for this purpose, since mercaptide renders it inactive. Therefore it may be more advantageous to use other solutions.

Mercaptide can be added into white liquor used as cooking liquor, which white liquor has not been treated in the production of polysulfide cooking liquor and which is taken into the cook after the impregnation stage. This allows decreasing the loading in the production of polysulfide cooking liquor.

In an embodiment the alkali required for the gas scrubber is a mixture of sodium hydroxide and white liquor, whereby the NaOH and white liquor are mixed so that the temperature settles in a region of 0-50° C., whereby the need for sodium hydroxide is decreased. With the presented embodiments it is possible to make solutions by means of which gaseous mercaptan can be recovered as mercaptide into the cooking process. It is essential that an adequately low temperature can be maintained in the absorption process, whereby the amount of alkali needed for the absorption is low and whereby the amount of orange liquor added into the beginning of the cook decreases only marginally, i.e. less than 1% calculated on wood.

When producing cellulose pulp from comminuted cellulosic fibrous material in a continuous cook, two types of digesters are mainly used: hydraulic digesters and two-phase i.e. vapor-liquid phase digesters. A hydraulic digester is a pressure-proof vessel that is completely filled with liquid and wood chips, which in the digester are converted into pulp fibers, and therein the feed of liquid into the vessel or discharge of the liquid from the vessel has an impact on the typical overpressure prevailing in the vessel. A vapor phase digester is not completely filled with liquid, but its upper part contains pressurized vapor that forms at the top of the digester a heat transfer space. By adjusting the pressure of the vapor, the pressure required by the whole cooking process is simultaneously adjusted.

The digester can be an only cooking vessel of the chemical pulp production system, a so-called single vessel system, or the cooking process can be carried out in two vessels, a so-called two-vessel system, whereby the system comprises a second vessel, which typically is an impregnation vessel that is hydraulically filled. In a single vessel system the impregnation stage takes place instead in the upper part of the digester vessel.

The chips are fed into the impregnation vessel or into the digester with various mechanical devices. Wood chips or other comminuted cellulosic fibrous material, which typically comprises rejects or knots and to a minor extent sawdust and pin chips, is typically fed into an inlet of a continuous digester by means of a separate feed system. The feed system typically comprises devices, by means of which air is removed from the chips, the chips are heated, pressurized and augmented with cooking liquor, before the slurry formed of chips and liquor is pressurized and fed into an impregnation vessel or fed into a digester. These include e.g. a TurboFeed™ system provided by Andritz. In a hydraulic digester and an impregnation vessel the slurry of chips and liquor is fed by means of a downwardly oriented screw-type conveyor referred to in the field as a "top separator" or a "top screw". A top separator discharges excess liquid from the suspension for returning it into the feed system as liquid for formation of a slurry.

The new method can be applied both for a continuous cook, a modified batch cook, and with certain conditions also for a conventional batch cook.

Introduction of mercaptan-containing gas suites for a continuous vapor phase digester, where the gas can be led into its vapor phase space.

Introduction of mercaptide-containing alkaline liquor is independent on the cooking method.

Mercaptide-containing alkali is introduced into the process so that it is in contact with the chips as soon as the cooking begins after the impregnation stage. Alkaline liquor can advantageously be introduced by at least the following ways:

In a two-vessel system, where the digester is a hydraulic digester or a vapor-liquid phase digester, the alkaline liquor is introduced into a transfer circulation between the impregnation vessel and the digester, which circulation leads into the digester.

In a two-vessel vapor-liquid phase digester system the alkaline liquor is introduced to the top screw of the digester so that it is admixed in the chips.

In a two-vessel hydraulic digester the alkaline liquor can be introduced into the liquid phase of the digester as a separate stream. On the other hand, the mercaptan can be added in gaseous form together with a vapor stream, whereby it is absorbed into the alkaline liquor in the digester.

The new method can be applied also in connection with single vessel digesters. Then the polysulfide impregnation takes place at the beginning of the cook at a temperature below 145° C., and the mercaptide-containing liquor is typically added immediately after the impregnation into the liquor circulation, cooking circulation or Lo-Solids® cooking circulation of the digester, which circulation can typically be provided with an inlet conduit for dilution liquor, as known per se.

Since there are very many kinds and types of liquor circulations and liquor streams of continuous cooking, it is essential to recognize the principles related to them in view of polysulfide and mercaptide both in single vessel and two-vessel digester systems. The polysulfide is added into the cook immediately at the beginning of the cook and it is let to be impregnated at a temperature of below 140-145° C. so that substantially all alkali, which forms at least 65%, preferably at least 85% of the total alkali of the cooking process, is added as orange liquor into this stage of the cook. From literature and performed experiments it is not possible to determine an absolute limit for degradation of polysulfide, but the range is between 140-145° C. In the cooking stage alkali is added, which has been used for absorption of mercaptan and in this stage the temperature is raised above 145° C., i.e. to cooking temperature. In this stage the polysulfide has been consumed during impregnation and the cooking reactions start when the alkaline salt of mercaptan has been added into the process.

If the PS-MM cook is performed as a single vessel cook, the mercaptide has to be introduced into the cook as a solution. A conventional single vessel cook at its simplest has three screen rows, the uppermost of which is for cooking circulation, from the second the extraction liquor is taken and the third is for washing and for adjusting the blow temperature. In this kind of digester the MM-containing solution is introduced into the cooking circulation, whereby the pulp is heated to cooking temperature and the cooking solution continues downwards co-currently towards the extraction screens. At the extraction screens the liquor entering from below counter-currently displaces the cooking liquor so that the black liquor of the cook exits via the screens to heat recovery. If there are less screen rows, then only two screen rows are used, the upper of which is the cooking circulation, into which the mercaptide solution can be introduced and from the lower one the extraction liquor is taken. Then washing and pulp cooling is limited to the bottom of the digester only.

If the cook is a Lo-Solids® cook without Hi-Heat washing, the digester is provided with three screen rows and at least a cooking circulation. The uppermost screen row is for upper extraction, from which liquor used in impregnation and countercurrent cooking zone is taken. The second screen row is a screen row of the cooking zone, at which also a central pipe is arranged. In this circulation the liquor is heated to cooking temperature, augmented with a dilution solution and alkaline solution and in this case also a mercaptide solution. According to flow balance, a portion of the heated cooking liquor flows counter-currently towards the upper extraction, displacing the impregnation liquor and a portion flows co-currently towards the lowest third screen row, from which the lower extraction is taken. Below the lowest screen row, bottom washing and the cooling of the pulp to blow temperature are arranged. The arrangement is suitable both for a hydraulic digester and vapor-liquid phase digester in connection with both a conventional cook and a Lo-Solids® cook.

If the digester is provided with Hi-Heat washing, it is arranged below the lower extraction screen and a fourth screen row is arranged for bottom washing. However, this does not change the concept of the cook, when impregnation and cook are observed with respect to two or three uppermost screen rows.

Mercaptan-containing gas can typically be produced when a black liquor stream extracted from the digester is evaporated using steam, typically live steam, as heating medium, whereby steam needed in the cooking process and evaporated black liquor are generated. The steam generated in black liquor evaporation contains sulfur compounds, especially hydrogen sulfide ($H_2S$), methyl mercaptan (MM), dimethyl sulfide (DMS) and dimethyl disulfide (DMDS). The steam can used for heating the fibrous material in the digester, whereby the mixture of steam and odorous gas at high pressure is taken to the top of the digester. Since not all the gas can be separated from the evaporator at a high pressure, the pressure of the steam has to be increased for leading it to the top of the digester even from a lower pressure. The sulfur-containing gas can be led to the cook e.g. by means of a compressor, but in that case also a considerable amount of those gases that evaporate from black liquor and which are not advantageous for the process are also passed to the top of the digester. Gases are often explosive, whereby the operation of the compressor is to be designed paying attention to special safety factors.

Addition of mercaptan in gaseous form is one feasible solution. However, gas handling under the conditions of a chemical pulp mill is demanding in view of safety factors. A lot of inert compounds enter with the gas, which also hampers adding gaseous mercaptan into the cook. Additionally, transfer of gas into a pressurized vessel with compressors consumes a lot of energy, whereby transfer of gas into a digester is probably more expensive in view of operational costs.

In an embodiment a water ring compressor acts as a gas scrubber. In that case the water ring compressor is provided with double-acting mechanical seals, whereby sealing water is prevented from entering the gas process. Then the water ring liquid is alkali and during compression of the gas the mercaptan is thus absorbed into the alkali while other odorous gases continue further e.g. to the recovery boiler without a separate fan.

These applications show that there are several various ways to produce alkali salt of methyl mercaptan. It is enough to make a methyl mercaptan containing gas contact with alkali so that a reaction is caused. Thus, the invention is not limited to the method according to which the mercaptide-containing salt is produced.

Polysulfide cooking has typically been connected to softwood cooking and most reasoning for its use is connected to softwood. Nevertheless, it is obvious that a polysulfide-mercaptide cook is also applicable for hardwood species. The impact is then not quite the same, but still chemical modification of the cook allows also modifying the properties of the fibers.

SUMMARY OF THE DRAWINGS

The invention is described in more detail with reference to the appended drawing, in which FIG. 1 presents a two-vessel digester system, in connection with which the present invention can be applied.

DETAILED DESCRIPTION

In the exemplary embodiment presented in FIG. 1 an impregnation vessel 10 is connected to a conventional vertical continuous digester 11, which can be a hydraulic digester or a vapor-liquid phase digester.

White liquor is fed via line 2 to polysulfide production 3, such as to the Moxy-process known per se. At least 65%, preferably over 85% of the alkali charge required by the cooking process is added as polysulfide cooking liquor 6 together with fibrous material 5, such as steamed wood chips, into an impregnation stage 10.

The fibrous material is treated in the impregnation vessel 10 at a temperature that is below 145° C., typically 100-135° C. The length of the impregnation can be, depending on the application, even two hours, but most typically the length of polysulfide impregnation is 20-60 minutes. Effects of a shorter period of impregnation have not been verified industrially, but it is highly probable that impregnation periods of 10-20 minutes might be possible, if the chips are properly steamed and thus the penetration and impregnation of orange liquor is quick. The conditions of impregnation are chosen so that the cooking reactions do not essentially start but the temperature is maintained below 145° C. The calculating of the H-factor starts at a temperature of approximately 140° C., and it is commonly considered the lowest limit of starting of the cooking reactions.

The impregnated slurry of fibrous material and cooking liquor is taken via line 7 into the cooking stage 11. In the digester the slurry is heated to cooking temperature of over 145° C. with steam or hot cooking liquor. According to the new method, mercaptide is introduced into the slurry of fibrous material before the cooking temperature is reached.

The mercaptan-containing alkali is introduced into the process so that it is in contact with the chips immediately as the cooking starts in the digester 11. FIG. 1 illustrates a two-vessel system.

If the cook is performed in a hydraulic digester, the mercaptide can be introduced absorbed in cooking liquor, which is added for supplementing the required alkali charge. In FIG. 1 white liquor is led via line 4 into an absorption device 8, into which also odorous gases 12 of the mill are introduced. Mercaptide is absorbed from the odorous gases into the white liquor, and unreacted odorous gas is taken via line 13 into further treatment, such as combustion. The mercaptide-containing cooking liquor is led via line 9 to the upper part of the digester, where it is present when the slurry of fibrous material reaches the cooking temperature. In the cooking stage the cooking liquor thus comprises the polysulfide liquor introduced into the impregnation stage and the mercaptide-containing cooking liquor introduced into the cooking stage, which liquor does not essentially contain polysulfide.

The mercaptide-containing cooking liquor can alternatively or additionally be led via line 15 into a transfer circulation line 7 between the impregnation vessel and the digester, which line extends into the digester 11. In this case the digester 11 can be a hydraulic or a vapor-liquid phase digester.

If the digester 11 is a vapor-liquid phase digester, the mercaptide-containing cooking liquor can be led to a top separator (not shown) of the digester so that it is admixed into the slurry of chips.

Cooked pulp exits from the bottom of the digester and is led to further treatment via line 14.

The digester 11 can comprise, in the upper part of the digester and belonging to the beginning of the cook, a first extraction screen array 16 and a circulation line 17, which are known per se. A portion of the circulation line 17 is shown in FIG. 1 and a portion not shown in the figure returns the liquor in the circulation to the feed line 7 and/or the digester vessel, as is conventional for circulation lines. The digester vessel 11 can comprise also other screen arrays 16, or the digester 11 can comprise any number of screens 16. Via a screen array 16 a portion of the cooking liquor is separated into the circulation line 17. Further, a branch flow, via line 18 can be separated from this, which is cooled 19 and directs cooking liquor to the absorption device 8. While in the absorption device, the cooking liquor adsorbs mercaptan-containing gas, such as odorous gas. The branch flow is returned via return line 20 to the circulation line 17 to be combined with the circulation liquor. Thus, the circulation liquor comprises mercaptide that is taken into the slurry of fibrous material before it is heated into cooking temperature.

If the cook is performed in a vapor phase digester of a two-vessel system, the mercaptide can be introduced entrained in heating steam, which is a steam containing mercaptide and other sulfur compounds, e.g. from the evaporation of black liquor extracted from the digester. Also white liquor is introduced into the cook for supplementing the alkali charge.

EXAMPLE

Air dried softwood chips were cooked in a laboratory under the following conditions with different alkali solutions: a kraft cooking liquor, a methyl mercaptane (MM) cooking liquor, a polysulfide (PS) cooking liquor and a PS-MM-cooking liquor (table 1).

TABLE 1

| Cooking conditions | Softwood |
|---|---|
| Dry solids content of the chips | 55% |
| Cooking liquor | |
| sulphidity (kraft/polysulfide) | 41%/30% |
| polysulfide concentration, g/L | 7.5 |
| MM charge, kg S/ts | 6.0 |
| liquor to wood ratio | 3.5 |
| Steaming time (100° C.), minutes | 30 |
| Impregnation time (115° C.), minutes | 60 |
| Cooking time (varying temperature), minutes | 150 |

The results are presented in table 2. The yield of the PS-MM-cook was 1.7% higher compared to the yield of the kraft-cook.

TABLE 2

| Softwood (kappa 30) | Total alkali (effective alkali, % on wood) | H factor | Yield (% on wood) | Rejets (% pulp) | Alkali consumption (% on wood) |
|---|---|---|---|---|---|
| Kraft reference | 19.5 | 960 | 47.8 | 0.02 | 15.8 |
| MM | 19.7 | 870 | 47.8 | 0.03 | 15.7 |
| Polysulfide | 20.8 | 975 | 48.7 | 0.05 | 16.9 |
| Polysulfide + MM | 20.4 | 950 | 49.5 | 0.02 | 16.7 |

The invention claimed is:

1. A method of producing chemical pulp, said method comprising at least the following steps:

a) treating wood chips and/or other comminuted lignocellulosic fibrous material with a polysulfide-containing cooking liquor in an impregnation stage at a temperature in a range of 90° C. to 145° C., and b) heating and cooking in a digester vessel a slurry of the treated wood chips and/or other comminuted lignocellulosic fibrous material obtained from step a) to produce pulp;

c) extracting cooking liquor from screens of the digester vessel;

d) cooling the extracted cooking liquor;

e) adding mercaptide ions to the extracted cooking liquor by adsorbing a mercaptan-containing gas into the extracted cooking liquor, and f) adding the extracted and cooled cooking liquor with the mercaptide ions to the slurry of the treated wood chips and/or other comminuted lignocellulosic fibrous material before and/or during step b).

2. The method according to claim 1, wherein in step a) at least 65% of an alkali charge required by the cooking of step b) is dosed into the slurry in a polysulfide liquor.

3. The method according to claim 1, wherein a portion in a range of 0.2% to 35% of an alkali charge required by the cooking of step b) is added to the slurry after step a).

4. The method according to claim 1, wherein the slurry contains the mercaptide ions when the slurry is heated to a cooking temperature of at least 140° C.

5. The method according to claim 1, wherein the extracted and cooled cooking liquor with the mercaptide ions is introduced in cooking liquor added to the slurry during step b).

6. The method according to claim 1, wherein the extracted and cooled cooking liquor with the mercaptide ions is added via a cooking circulation or a liquor circulation of the digester vessel in which step b) is performed.

7. The method according to claim 1, wherein the cooking is a continuous cook and the digester vessel is a single vessel or in separate vessels.

8. The method according to claim 1, wherein the digester vessel in the step b) is a vapor-liquid phase digester vessel and additional mercaptan ions are included in a mercaptan-containing gas that is introduced into a vapor space of the vapor-liquid phase digester vessel.

9. The method according to claim 1, wherein the step a) is carried out in an impregnation vessel and the step b) in carried out in a digester vessel, whereby the extracted and cooled cooking liquor with the mercaptide ions is introduced into a transfer circulation line that conveys the slurry from the impregnation vessel to the digester vessel.

10. The method according to claim 1, wherein the step a) is carried out in an impregnation vessel and the digester vessel in step b) is a vapor-liquid phase digester vessel, whereby the extracted and cooled cooking liquor with the mercaptide ions is introduced to a top separator of the vapor-liquid phase digester vessel.

11. The method according to claim 1, wherein the step a) and the step b) are carried out in a single cooking vessel which includes the digester vessel, wherein absorption of polysulfide into the fibrous material takes place in an upper part of the single cooking vessel.

12. The method according to claim 1, wherein the cooking is a modified batch cook.

13. The method according claim 1, wherein the mercaptide ions originate from sulfur compounds-containing gases produced in a chemical pulp mill.

14. The method according to claim 1, wherein the mercaptide ions are added in the amount in a range of one to ten kg S (sulfur)/adt pulp.

15. A method of producing chemical pulp comprising:

impregnating comminuted lignocellulosic fibrous material with a polysulfide-containing cooking liquor in an impregnation vessel at a temperature in a range of 90° C. to 145° C. to produce a slurry containing the comminuted lignocellulosic fibrous material and the polysulfide;

conveying the slurry from the impregnation vessel to a digester vessel by a liquor circulation conduit extending from the impregnation vessel to the digester vessel;

cooking the slurry in the digester vessel at a temperature above 145° C. to produce a chemical pulp;

extracting a cooking liquor from a screen in the digester vessel;

cooling the extracted cooking liquor;

adding mercaptide into the extracted and cooled cooking liquor; and adding the extracted and cooled cooking liquor with the mercaptide into the slurry during the conveyance of the slurry and/or the cooking of the slurry.

* * * * *